US006299159B1

(12) United States Patent
Battle et al.

(10) Patent No.: US 6,299,159 B1
(45) Date of Patent: Oct. 9, 2001

(54) DIRECT CURRENT MINIATURE PAPER JOGGER

(75) Inventors: William Froman Battle, Canton; Philip D. Klug, Westland, both of MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/468,184

(22) Filed: Dec. 21, 1999

(51) Int. Cl.[7] ..... B65H 31/36
(52) U.S. Cl. ..... 271/221
(58) Field of Search ..... 271/221, 224, 271/146, 210; 414/789.1; 368/97

(56) References Cited

U.S. PATENT DOCUMENTS

| | | | |
|---|---|---|---|
| 2,274,713 | 3/1942 | Kushera . | |
| 2,277,511 | 3/1942 | Daneke . | |
| 2,494,075 | 1/1950 | Scheinker . | |
| 2,573,164 | 10/1951 | Scheinker | 271/89 |
| 2,661,950 | 12/1953 | Weyandt . | |
| 2,883,191 | 4/1959 | Peugnet . | |
| 3,252,703 | 5/1966 | Peugnet . | |
| 3,391,929 | 7/1968 | Blair . | |
| 3,559,984 | 2/1971 | Westra . | |
| 3,862,752 * | 1/1975 | Totten | 271/210 |
| 4,345,753 | 8/1982 | Marshall . | |
| 4,371,155 | 2/1983 | Astero et al. . | |

FOREIGN PATENT DOCUMENTS 11-157738-A * 6/1999 (JP) ..... B65H/31/40

* cited by examiner

*Primary Examiner*—Christopher P. Ellis
*Assistant Examiner*—Kenneth W Bower
(74) *Attorney, Agent, or Firm*—Harness, Dickey & Pierce; Mark T. Starr

(57) ABSTRACT

A battery powered paper jogger can be placed on a countertop for individual use. The paper jogger includes a power module for receiving DC power from a DC power source, and a vibration system for producing vibratory motion in response to the DC power. The paper jogger also includes a housing enclosing the power module and coupled to the vibration system such that the vibratory motion of the vibration system is transferred to the housing. A preferred embodiment of the present invention includes a timer for generating a control signal upon expiration of a predetermined amount of time or upon manual termination, and a switching mechanism disposed between the DC power source and the vibration system. The switching mechanism disconnects the DC power source from the vibration system in response to the control signal.

24 Claims, 7 Drawing Sheets

DIRECT CURRENT MINIATURE PAPER JOGGER

FIELD OF THE INVENTION

The invention relates to paper joggers. More specifically, the invention concerns a battery powered paper jogger designed for individual use.

BACKGROUND ART

Banks, credit unions and other financial institutions regularly process checks, deposit slips and other types of bank documents in order to execute financial transactions efficiently. Document processing systems have therefore become quite prevalent in the industry. In order for these document processing systems to accept and process stacks of documents, generally the edges of the documents must be substantially aligned. Before automation, this alignment was done by hand and was often quite time consuming. Over the years, however, automated paper joggers have evolved to support the increasing use of electronic document processing systems.

A substantial shortcoming of conventional paper joggers has been the size and audible noise associated with the joggers. For example, a typical paper jogger for aligning U.S. currency is floor standing, immobile, and produces significant noise and vibration. Similar systems are in use for checks, receipts, and deposit slips. Generally, due to the above problems a bank will locate such a paper jogger in an isolated location to prevent nuisance to customers and employees. Such a solution, however, is inefficient and costly.

The lack of efficiency and costliness of conventional paper joggers is also due to the fact that in the past few years, new document processing systems have been developed for individual use at the location of the bank teller. Thus, documents must be aligned in one location and processed in another. This increases the time required to service each customer and increases overhead costs. It is therefore desirable to provide a paper jogger which is small enough and quiet enough to be placed on a countertop for individual use.

Conventional paper joggers are also extremely complex. For example, it is not uncommon for such a device to incorporate multiple level jogging tables, offset weighting configurations, and complicated spring mechanisms. This complexity adds to the initial cost as well as upkeep of the device. These paper joggers also require AC power and have negligible mobility. It is therefore desirable to provide a paper jogger with fewer components and the ability to operate from a totally internal power supply.

SUMMARY OF THE INVENTION

In a first aspect of the invention a paper jogger includes a power module for receiving DC power from a DC power source, and a vibration system for producing vibratory motion in response to the DC power. The paper jogger also includes a housing enclosing the power module and coupled to the vibration system such that the vibratory motion of the vibration system is transferred to the housing. A preferred embodiment of the present invention includes a timer for generating a control signal upon expiration of a predetermined amount of time, and a switching mechanism disposed between the DC power source and the vibration system. The switching mechanism disconnects the DC power source from the vibration system in response to the control signal.

In a second aspect of the invention, a paper jogger power module for retrieving DC power from a DC power source includes a battery compartment, a timer, and a switch. The battery compartment retrieves the DC power from an internal battery, and the timer generates a control signal upon expiration of a predetermined amount of time. The switch is disposed between the DC power source and the vibration system and disconnects the DC power from the vibration system in response to the control signal.

In a third aspect of the invention, a method for jogging paper documents in response to a vibratory motion includes the step of retrieving DC power from a DC power source. Vibratory motion is produced in response to the DC power, and the vibratory motion is transferred to the paper documents. In a preferred embodiment of the invention, the method includes the steps of generating a control signal upon expiration of a predetermined amount of time, and disconnecting the DC power in response to the control signal.

BRIEF DESCRIPTION OF THE DRAWINGS

The invention is set forth in exemplary fashion by the following detailed description of a preferred embodiment taken in conjunction with the drawings, in which.

DETAILED DESCRIPTION OF THE PREFERRED EMBODIMENTS

Figure 1:
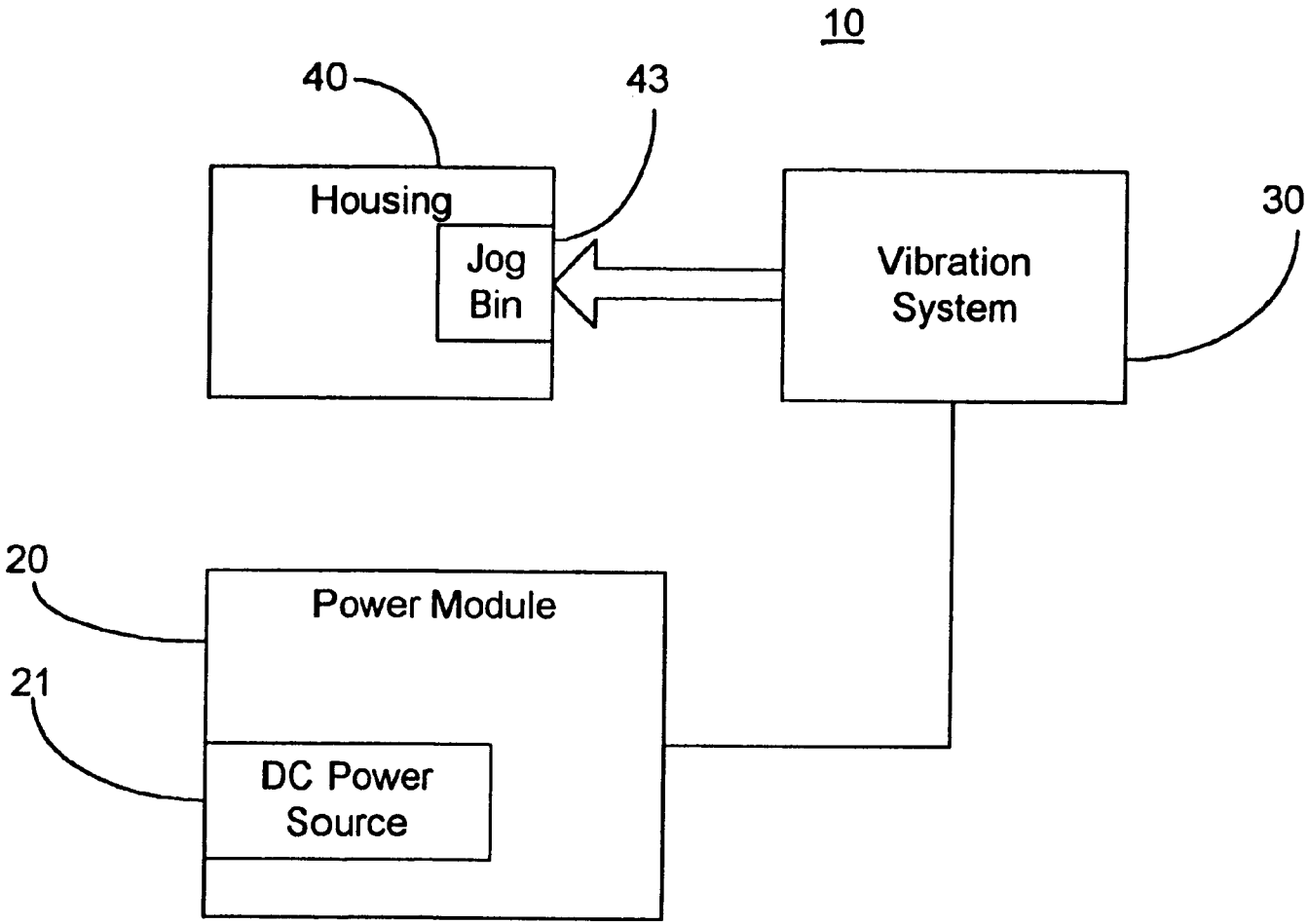
FIG. 1 is a block diagram of a paper jogger in accordance with the principals of the invention.

Turning now to FIG. 1, a paper jogger for individual use is shown at 10. The paper jogger 10 has a power module 20 for retrieving DC power from a DC power source 21. A vibration system 30 produces vibratory motion in response to the DC power. The paper jogger 10 also has a housing 40 enclosing the power module 20 and coupled to the vibration system 30 such that the vibratory motion of the vibration system 30 is transferred to the housing 40. Housing 40 has a jog bin 43 to be described later. Use of a DC power source provides substantial mobility to the paper jogger 10. As will be discussed below, the vibration system 30 is designed to provide maximum vibratory motion with as few components as possible. This allows the paper jogger 10 to have a footprint of approximately 25 square inches.

Figure 2:
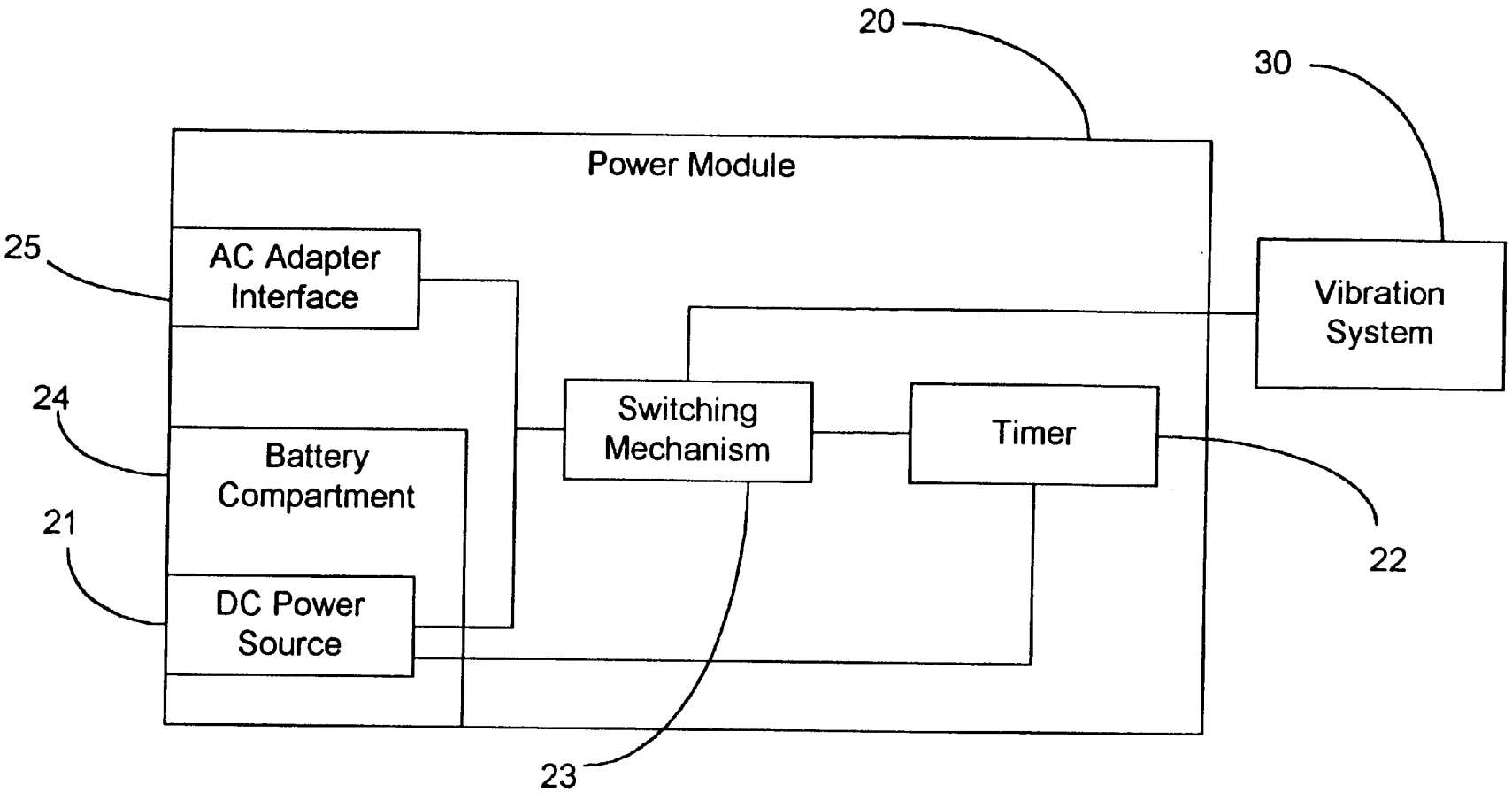
FIG. 2 is a block diagram of a power module in accordance with the principals of the invention.

As shown in FIG. 2, the power module 20 generally has a timer 22 for generating a control signal upon expiration of a predetermined amount of time. Thus, the timer 22 can be programmed for the type and number of documents being aligned. The switching mechanism 23 is disposed between the DC power source 21 (and AC adapter interface 25) and the vibration system 30 such that the switching mechanism 23 disconnects the DC power from the vibration system 30 in response to the control signal from the timer 22. The timer 22 can be either an electronic timer or a mechanical timer well known in the art. Similarly, the switching mechanism 23 can be an electronic switch such as a bipolar or field effect transistor, or a mechanical switch such as a relay. Timer 22 and switch mechanism 23 can also be implemented in a single semiconductor device commonly available and known in the art. The power module 20 also has a battery compartment 24 for retaining an internal battery while the DC power is retrieved from the internal battery. As already discussed, the power module 20 has an AC adapter interface 25 for retrieving DC power from an AC adapter (not shown).

Figure 6:
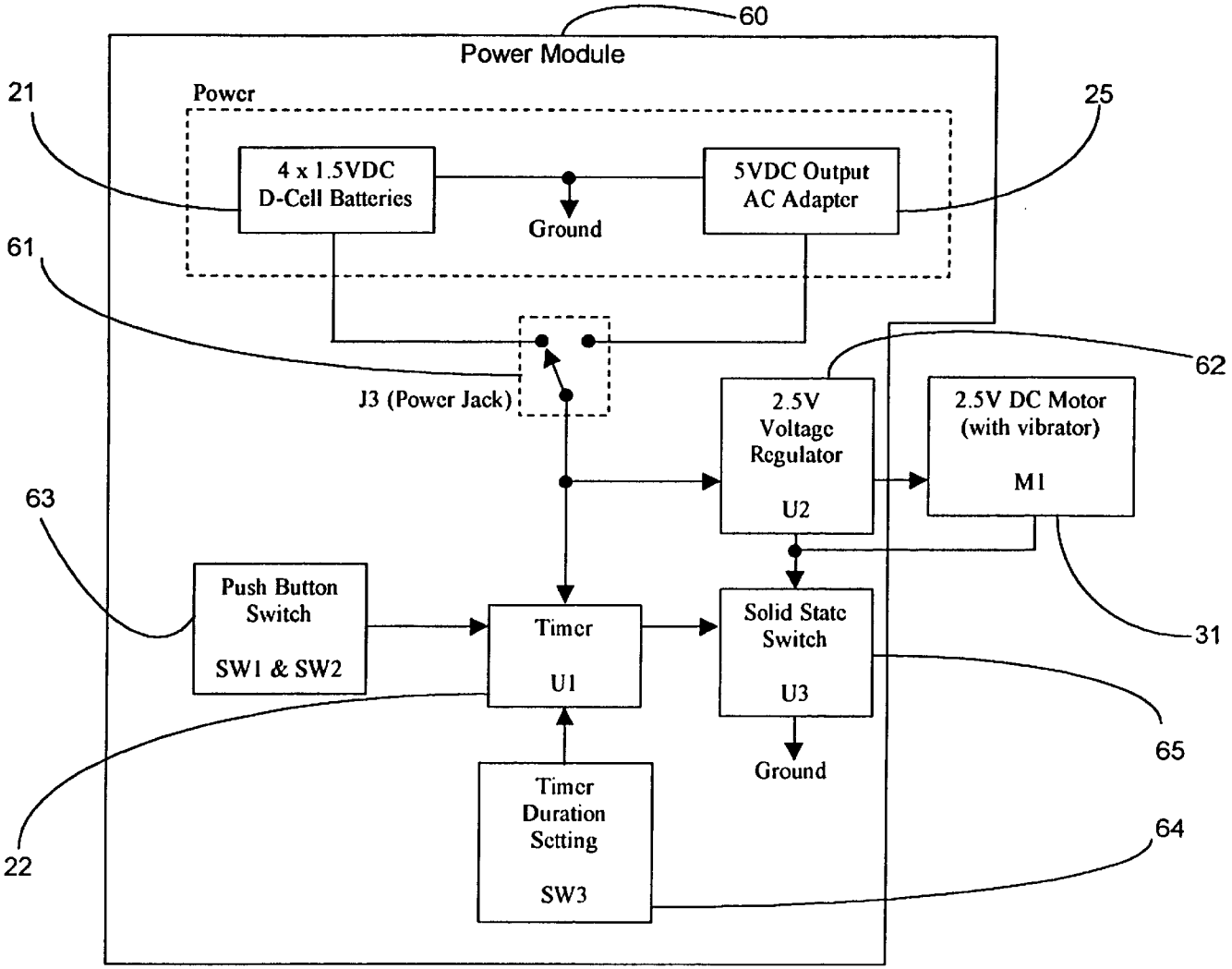
FIG. 6 is a block diagram of a preferred power module in accordance with the principals of the invention.
Figure 7:
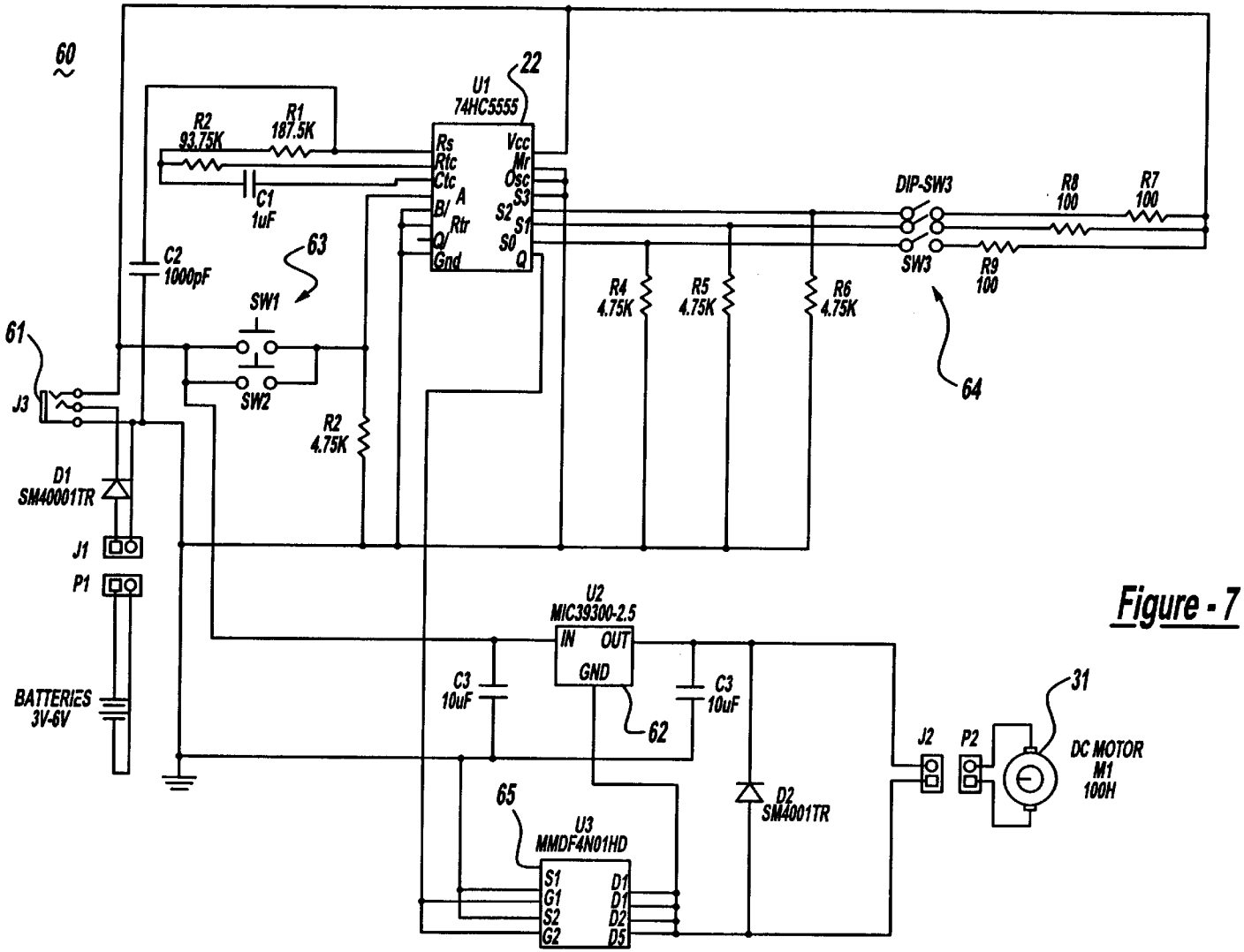
FIG. 7 is a circuit schematic implementing the power module shown in FIG. 6.

FIG. 6 demonstrates a preferred power module 60. It will be appreciated that in addition to the DC power source 21, the AC adapter interface 25, and the timer 22, the power module 60 includes other components. For example, a power jack 61 is provided for selecting between the DC power source 21 and the AC adapter interface 25. A voltage regulator 62 stabilizes the DC power supplied to the DC motor 31. Enhanced switching control is provided by push button switch mechanism 63, timer duration switch 64, and solid state switch 65. Thus, the timer 22 controls switching of solid state switch 65, where the duration can be controlled by the timer duration switch 64. FIG. 7 is a circuit schematic implementing the preferred power module 60.

Figure 3:
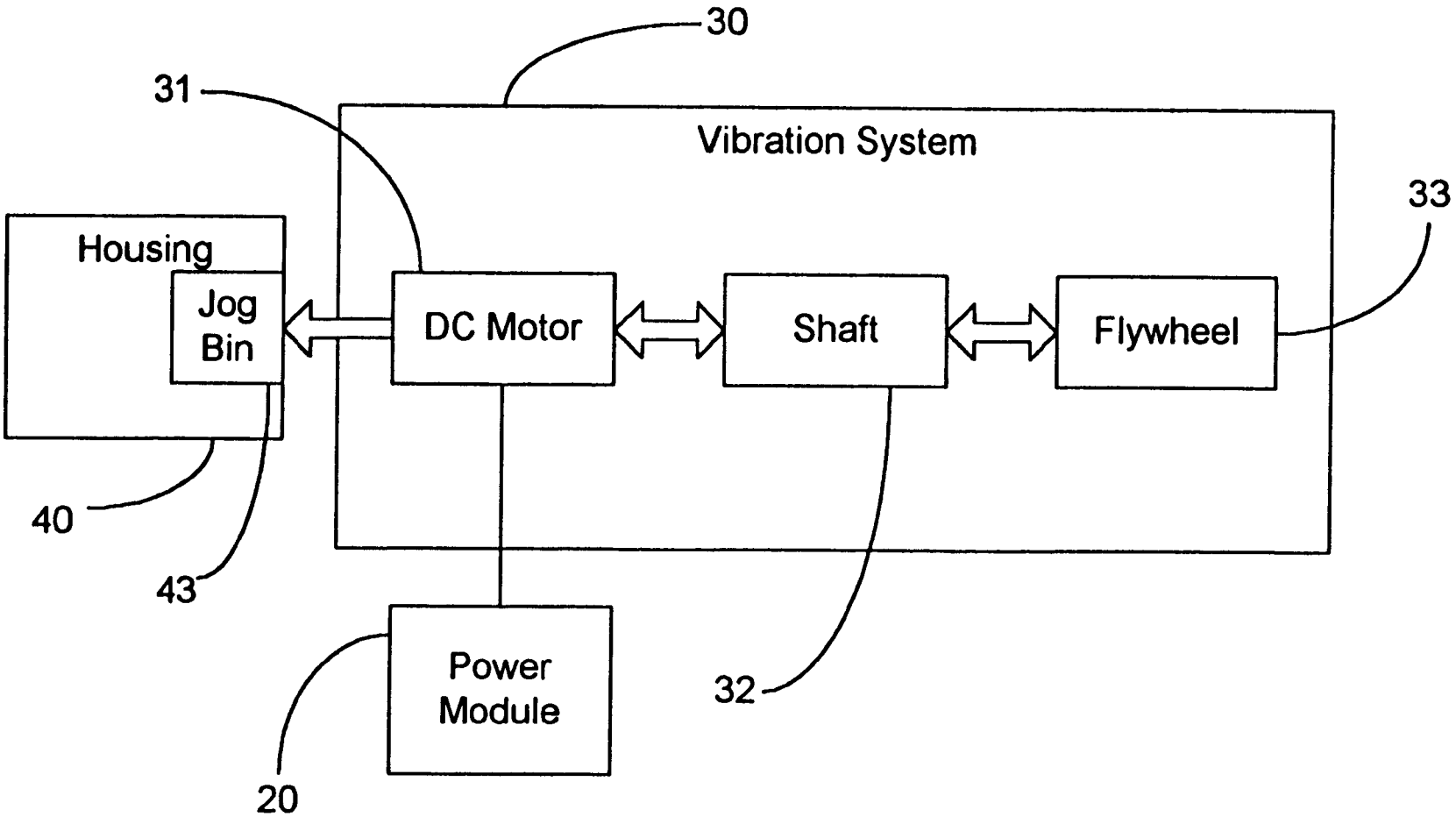
FIG. 3 is a block diagram of a preferred vibration system in accordance with the principals of the invention.
Figure 4A:
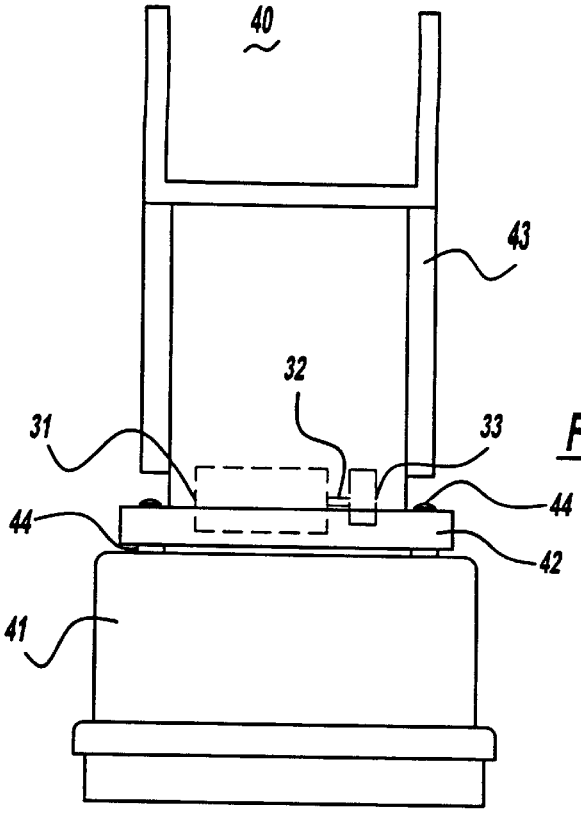
FIG. 4A is a side view of a DC motor, shaft, and offset flywheel in accordance with the principals of the invention.
Figure 4B:
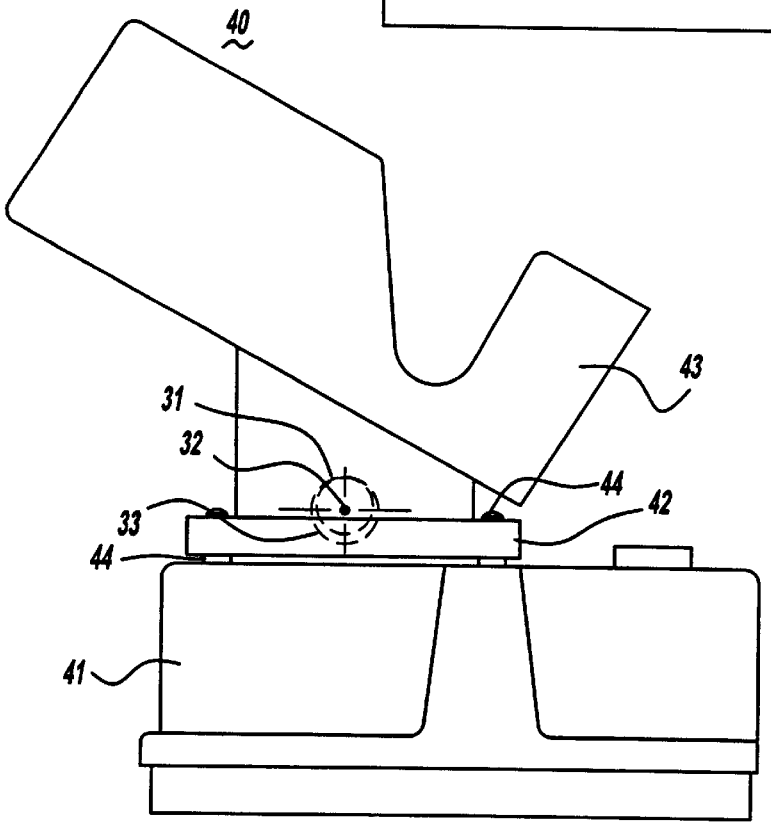
FIG. 4B is an end view of the DC motor, shaft, and offset flywheel shown in FIG. 4A.

Turning now to FIG. 3, it can be seen that the vibration system 30 preferably includes a DC motor 31 coupled to the housing 40. The DC motor 31 rotates a shaft 32 in response to the DC power. It can further be seen that an offset flywheel 33 is coupled to the shaft 32 such that rotation of the shaft 32 transfers vibratory motion to the housing 40. Turning to FIGS. 4A and 4B, the generation of vibratory motion can be better appreciated. FIG. 4A is a side view of the motor 31, shaft 32 and offset flywheel 33 as they relate to the housing 40. As best seen in FIG. 4B, rotation of shaft 32 causes non-concentric rotation of the offset flywheel 33. This non-concentric rotation causes vibratory motion in the motor 31 which is transferred to the housing 40.

Figure 5:
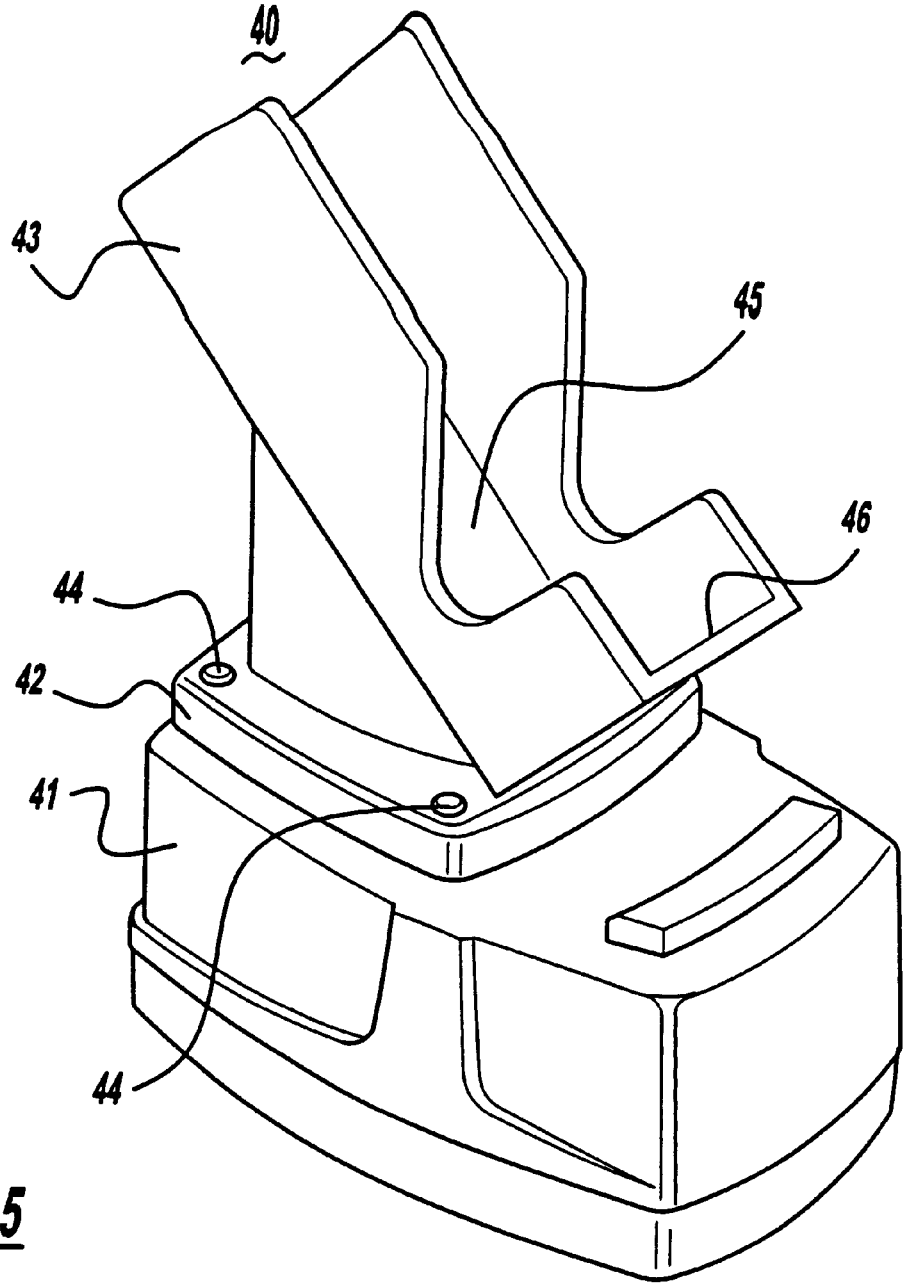
FIG. 5 is a plan view of a preferred paper jogger in accordance with the principals of the invention.

Turning now to FIG. 5, the housing 40 will be discussed in greater detail. It will be appreciated that the housing 40 has a first base 41, a second base 42, and a jog bin 43. Preferably, the first base 41 contains a motion limiting material, such that the motion limiting material prevents the vibratory motion from moving the first base 41. The second base 42 is coupled to the first base 41 by a plurality of standoffs 44. It can be seen that the second base 42 is coupled to the vibratory system (FIGS. 4A and 48) such that the vibratory motion moves the second base 42. The jog bin 43 is coupled to the second base 42 and holds the paper documents. Thus, the jog bin 43 jogs the paper documents in response to the vibratory motion. The plurality of standoffs 44 function to localize the vibratory motion to the second base 42 and the jog bin 43, while the first base 41 remains substantially stationary. While the preferred embodiment uses sand (not shown) as the motion limiting material in the first base 41, virtually any dense substance can be used. To reduce audible sound, the housing includes sound damping plastic such as Xenoy 15382-2, sold by G.E. Plastics. The jog bin 43 has a first alignment surface 45 for aligning the paper documents along a first edge of the documents, and a second alignment surface 46 for aligning the paper documents along a second edge of the documents.

In operation, DC power is retrieved from a DC power source, vibratory motion is produced in response to the DC power, and the vibratory motion is transferred to the paper documents. Furthermore, a control signal is generated upon expiration of a predetermined amount of time or upon manual termination, and the DC power is disconnected in response to the control signal. Preferably, the DC power can be retrieved either from a battery or an AC adapter.

The invention has been described with reference to a detailed description of a preferred embodiment for the sake of example only. The scope of the invention is to be determined by proper interpretation of the appended claims.

What is claimed is:

1. A paper jogger comprising:

a power module for retrieving DC power from a DC power source; and including a timer for generating a control signal upon expiration of a predetermined amount of time;

a vibration system for producing vibratory motion in response to the DC power;

a housing enclosing the power module and coupled to the vibration system such that the vibratory motion of the vibration system is transferred to the housing;

a switching mechanism disposed between the DC power source and the vibration system, the switching mechanism disconnecting the DC power from the vibration system in response to the control signal.

2. The paper jogger of claim 1 wherein the timer is an electronic timer.

3. The paper jogger of claim 1 wherein the timer is a mechanical timer.

4. The paper jogger of claim 1 wherein the power module further includes a battery compartment for retaining a battery while the DC power is retrieved from the battery.

5. The paper jogger of claim 1 wherein the power module further includes an AC adapter interface for retrieving DC power from an AC adapter.

6. The paper jogger of claim 1 wherein the vibration system includes:

a DC motor coupled to the housing, the DC motor having a shaft and rotating the shaft in response to the DC power; and an offset flywheel coupled to the shaft such that rotation of the shaft transfers vibratory motion to the housing.

7. The paper jogger of claim 1 wherein the housing includes:

a first base containing a motion limiting material, the motion limiting material preventing the vibratory motion from moving the first base;

a second base coupled to the first base by a plurality of standoffs, the second base coupled to the vibratory system such that the vibratory motion moves the second base; and a jog bin coupled to the second base for holding paper documents, the jog bin jogging the paper documents in response to the vibratory motion.

8. The paper jogger of claim 7 wherein the motion limiting material includes sand.

9. The paper jogger of claim 7 wherein the housing includes sound damping plastic.

10. The paper jogger of claim 7 wherein the jog bin includes:

a first alignment surface for aligning the paper documents along a first edge of the documents; and a second alignment surface for aligning the paper documents along a second edge of the documents.

11. A paper jogger power module for retrieving DC power from a DC power source, the power module comprising:

a battery compartment for retaining an internal battery while the DC power is retrieved from the internal battery;

a timer for generating a control signal; and a switching mechanism disposed between the battery and a vibration system, the vibration system producing vibratory motion in response to the DC power, the switching mechanism disconnecting the DC power from the vibration system in response to the control signal.

12. The paper jogger of claim 11 wherein the timer is an electronic timer.

13. The paper jogger of claim 11 wherein the timer is a mechanical timer.

14. A method for jogging paper documents in response to a vibratory motion, the method comprising the steps of:

retrieving DC power from a DC power source;

producing vibratory motion in response to the DC power; and transferring the vibratory motion to the paper documents;

generating a control signal upon expiration of a predetermined amount of time; and disconnecting the DC power from the vibration system in response to the control signal.

15. The method of claim 14 further including the step of retrieving the DC power from a battery.

16. The method of claim 14 further including the step of retrieving the DC power from an AC adapter.

17. The method of claim 14 further including the step of aligning the paper documents along a first edge of the documents.

18. The method of claim 17 further including the step of aligning the paper documents along a second edge of the documents.

19. A paper jogger for jogging paper documents comprising:

a power module for retrieving DC power from a DC power source;

a timer for generating a control signal upon expiration of a predetermined amount of time;

a vibration system for producing vibratory motion in response to the DC power;

a housing including a jog bin for holding the paper documents, said housing enclosing the power module and coupled to the vibration system such that the vibratory motion of the vibration system is transferred to the housing and the jog bin and;

a switching mechanism disposed between the DC power source and the vibration system, the switching mechanism disconnecting the DC power from the vibration system in response to the control signal.

20. A method for jogging paper documents in a document jogger in response to a vibratory motion, the document jogger having a housing for holding the paper documents, the method comprising the steps of:

retrieving DC power from a DC power source;

producing vibratory motion in a vibratory system in response to the DC power;

transferring the vibratory motion from the vibratory system to the housing to jog the paper documents;

generating a control signal upon expiration of a predetermined amount of time; and disconnecting the DC power from the vibration system in response to the control signal.

21. The method of claim 20, further including the step of retrieving the DC power from a battery.

22. The method of claim 20, further including the step of retrieving the DC power from an AC adapter.

23. The method of claim 20, further including the step of aligning the paper documents along a first edge of the documents.

24. The method of claim 23, further including the step of aligning the paper documents along a second edge of the documents.

* * * * *